US008149181B2

(12) United States Patent
Yen et al.

(10) Patent No.: US 8,149,181 B2
(45) Date of Patent: Apr. 3, 2012

(54) DIELECTRIC RESONATOR FOR NEGATIVE REFRACTIVITY MEDIUM

(75) Inventors: Ta-Jen Yen, Hsinchu County (TW); Yue-Jun Lai, Taichung County (TW); Cheng-Kuang Chen, Taichung (TW)

(73) Assignee: National Tsing Hua University, Hsinchu (TW)

( * ) Notice: Subject to any disclaimer, the term of this patent is extended or adjusted under 35 U.S.C. 154(b) by 401 days.

(21) Appl. No.: 12/552,762

(22) Filed: Sep. 2, 2009

(65) Prior Publication Data

US 2011/0050367 A1 Mar. 3, 2011

(51) Int. Cl.
*H01Q 15/02* (2006.01)
*H01Q 1/38* (2006.01)

(52) U.S. Cl. ..... 343/911 R; 343/700 MS

(58) Field of Classification Search ..... 343/911 R, 343/909, 873, 700 MS
See application file for complete search history.

(56) References Cited

U.S. PATENT DOCUMENTS

| | | | | |
|---|---|---|---|---|
| 5,952,972 | A * | 9/1999 | Ittipiboon et al. | 343/700 MS |
| 6,768,454 | B2 * | 7/2004 | Kingsley et al. | 342/368 |
| 7,071,879 | B2 * | 7/2006 | Strickland | 343/700 MS |
| 2008/0272963 | A1 * | 11/2008 | Chang et al. | 343/700 MS |

* cited by examiner

*Primary Examiner* — Hoang V Nguyen
(74) *Attorney, Agent, or Firm* — Muncy, Geissler, Olds & Lowe, PLLC

(57) ABSTRACT

A dielectric resonator for a negative refractivity medium, which is coupled to a plurality of substrates, comprises at least one crystal unit, at least one first crystal cube and at least one second crystal cube. The crystal units are arrayed on the substrate. On an identical substrate, each crystal unit has a first spacing with respect to one adjacent crystal unit and a second spacing with respect to another adjacent crystal unit. The first spacing is vertical to the second spacing. Each crystal unit has one first crystal cube and one second crystal cube. A third spacing exists between the first and second crystal cubes. The first and second crystal cubes have a permittivity greater than 20. The present invention adopts the negative refractivity medium to achieve lower dielectric loss. Further, the present invention features isotropy and has low fabrication cost and high industrial utility.

12 Claims, 9 Drawing Sheets

DIELECTRIC RESONATOR FOR NEGATIVE REFRACTIVITY MEDIUM

FIELD OF THE INVENTION

The present invention relates a negative refractivity medium, and more particularly to a dielectric resonator for a negative refractivity medium.

BACKGROUND OF THE INVENTION

With the advance of science and technology, the wireless communication products used in various fields, including industry, science and medicine, are gradually diversified. Among them, in-vehicle phones and mobile phones grow especially fast. The state-of-the-art communication devices feature portability and low power consumption. The high frequency and middle high-frequency performance of the resonators, filters, capacitors, etc. used in the mobile communication devices are considered to be very important. Further, how to reduce the size and power consumption of devices is also an important topic in designing products.

When used in a WLAN (Wireless Local Area Network) system operating at a frequency band of 5.25 GHz, the conventional microstrip antenna has too high a conductor ohmic loss because of the high operation frequency. In the same case, the conventional dielectric resonator antenna does not have any conductor ohmic loss but has high radiation efficiency, low consumption and a high gain. Therefore, the dielectric resonator antenna is very suitable to be used in such a high frequency band. The conventional dielectric resonator antenna usually uses a material having a permittivity of 20-30 and has a height higher than the microstrip antenna. Sometimes, a dielectric resonator antenna adopts a material having a high permittivity (normally higher than 70) to reduce the size thereof, and more particularly to reduce the height thereof. However, a high permittivity causes a decreased operation bandwidth, which usually cannot meet the requirement of the bandwidth.

The BaO-rare earth oxide-$TiO_2$ system ceramic is one of the materials able to satisfy the abovementioned requirement. The BaO-rare earth oxide-$TiO_2$ system ceramic not only is likely to realize the miniaturization of the antenna but also is likely to achieve a high permittivity and a low dielectric loss. However, the BaO-rare earth oxide-$TiO_2$ system ceramic suitable for smaller high frequency devices has a very high permittivity. It is difficult and expensive to obtain a lower-permittivity BaO-rare earth oxide-$TiO_2$ system ceramic via introducing other additional components.

Accordingly, the present invention proposes a novel and advanced dielectric resonator technology to overcome the abovementioned problems.

SUMMARY OF THE INVENTION

The primary objective of the present invention is to provide a dielectric resonator for a negative refractivity medium, which features lower dielectric loss and isotropy.

To achieve the abovementioned objective, the present invention proposes a dielectric resonator for a negative refractivity medium, which is coupled to a plurality of substrates and comprises at least one crystal unit, at least one first crystal cube and at least one second crystal cube, wherein the crystal units are arrayed on the substrate, and wherein on an identical substrate, each crystal unit has a first spacing with respect to one adjacent crystal unit and a second spacing with respect to another adjacent crystal unit, and the first spacing is vertical to the second spacing, and wherein each crystal unit has one first crystal cube and one second crystal cube, and wherein a third spacing exists between the first and second crystal cubes, and wherein the first and second crystal cubes have a permittivity greater than 20.

The dielectric resonator for a negative refractivity medium of the present invention has the following advantages:

1. The present invention adopts a material have a permittivity greater than 20 to overcome the conventional problem of high dielectric loss. Thus, the present invention has a lower dielectric loss. Further, the present invention also features isotropy. Therefore, the present invention has significant industrial utility.

2. The present invention can easily overcome the conventional problem that the small-volume and low-permittivity elements are hard to assemble, via arranging many sets of two crystal cubes made of an identical material into an array. Therefore, the present invention can effectively reduce the fabrication cost and has high industrial utility.

DETAILED DESCRIPTION OF THE PREFERRED EMBODIMENTS

Below, the embodiments are described in detail to demonstrate the technical contents of the present invention. However, the embodiments are only to exemplify the present invention but not to limit the scope of the present invention.

Figure 1:
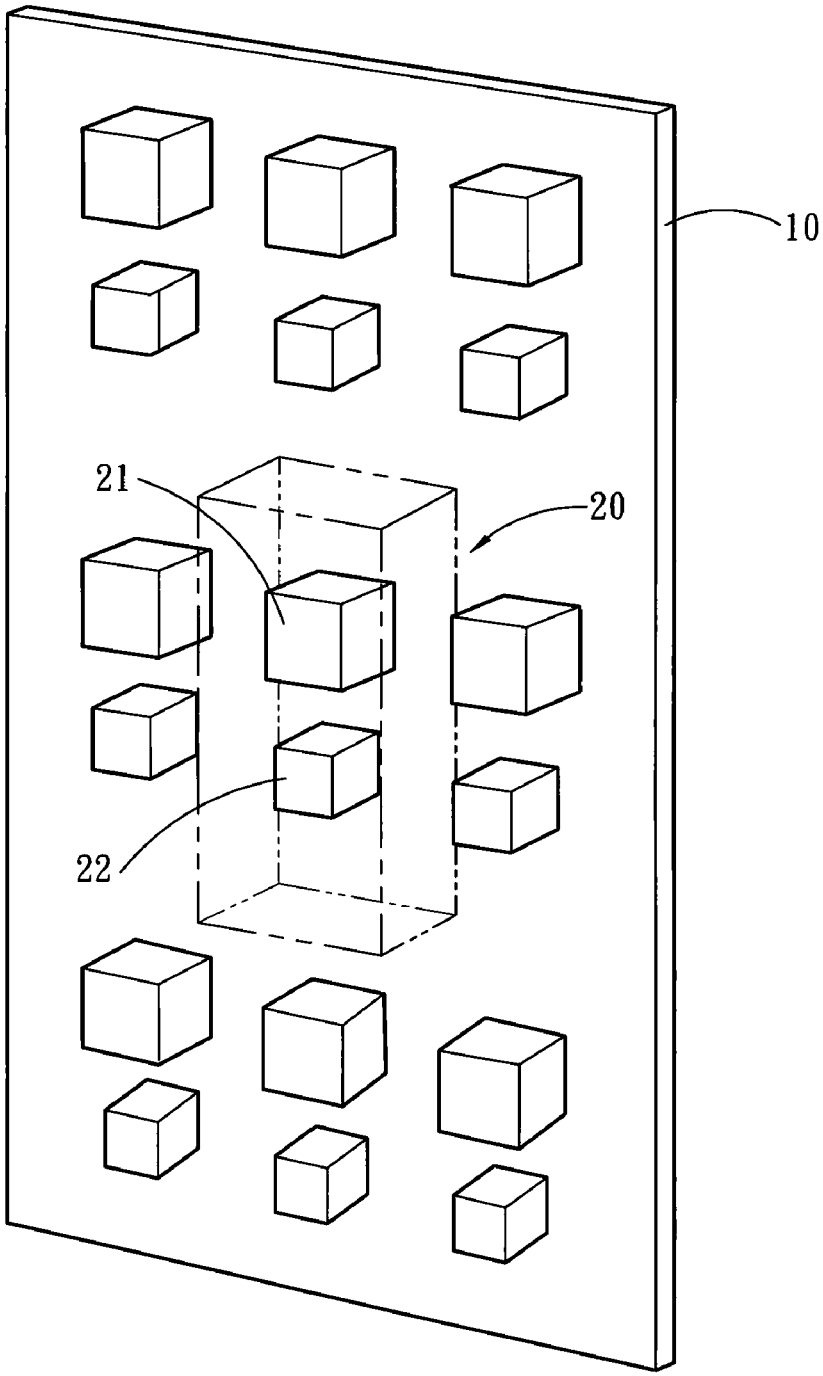
FIG. 1 is a perspective view schematically showing the structure of a dielectric resonator according to the present invention.
Figure 2:
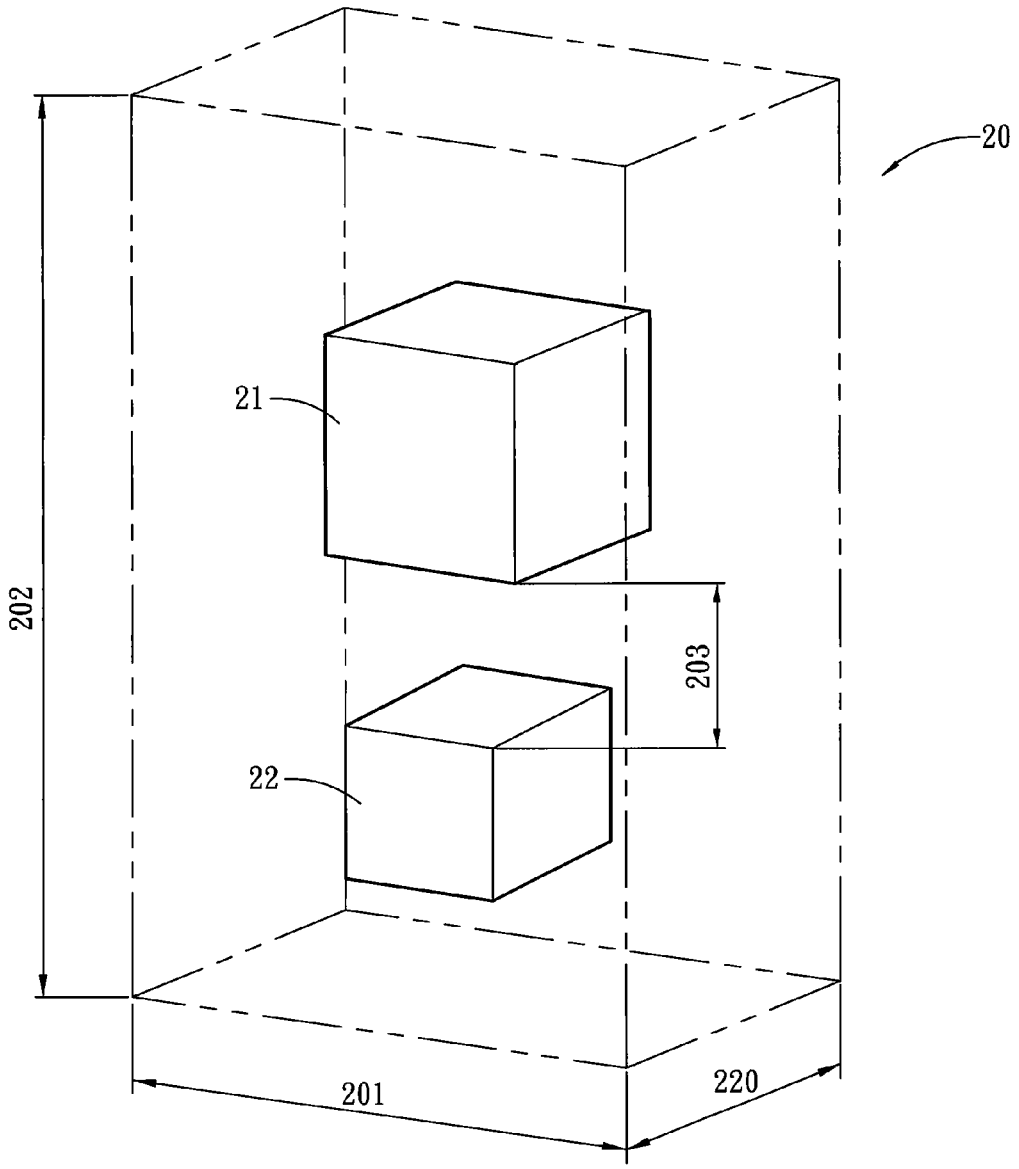
FIG. 2 is a perspective view schematically showing a crystal unit of a dielectric resonator according to the present invention.

Refer to FIG. 1 and FIG. 2 respectively show perspective views of the structure and a crystal unit of a dielectric resonator according to the present invention. The present invention proposes a dielectric resonator for a negative refractivity medium, which is coupled to a plurality of substrates 10 and comprises at least one crystal unit 20, at least one first crystal cube 21 and at least one second crystal cube 22, wherein the crystal units 20 are arrayed on the substrate 10, and wherein on an identical substrate 10, each crystal unit 20 has a first spacing 201 with respect to one adjacent crystal unit 20 and a second spacing 202 with respect to another adjacent crystal unit 20, and the first spacing 201 is vertical to the second spacing 202, and wherein each crystal unit 20 has one first crystal cube 21 and one second crystal cube 22, and wherein a third spacing 203 exists between the first and second crystal cubes 21 and 22, and wherein the first and second crystal cubes 21 and 22 have a permittivity greater than 20, and wherein the third spacing 203 is parallel to the substrate 10.

The substrate 10 is made of polystyrene. Polystyrene has a permittivity near the permittivity of air. The crystal unit 20 thus has a fourth spacing 220 vertical to the substrates 10 and separating the substrates 10. In this embodiment, the first spacing 201 is defined to be the X axis, the second spacing 202 is defined to be the Y axis, and the fourth spacing 220 is defined to be the Z axis.

The first spacing 201 ranges from 40 to 50 mm with 47.549 mm preferred. The second spacing 202 ranges from 20 to 30 mm with 22.149 mm preferred. The third spacing 203 ranges from 7 to 8 mm with 7.5 mm preferred. The fourth spacing 220 ranges from 20 to 30 mm with 22 mm preferred.

The volume of the first crystal cube 21 ranges from 7×7×10 to 10×10×10 $mm^3$ with 10×10×10 $mm^3$ preferred. The volume of the second crystal cube 22 ranges from 2×2×10 to 7×7×10 $mm^3$ with 6.5×6.5×10 $mm^3$ preferred. The material of the first and second crystal cubes 21 and 22 is selected from the group consisting of zirconium dioxide ($ZrO_2$), barium strontium titanate ($(Ba,Sr)TiO_3$), titanium dioxide ($TiO_2$), and lanthanum titanate ($LaTiO_3$).

Figure 3:
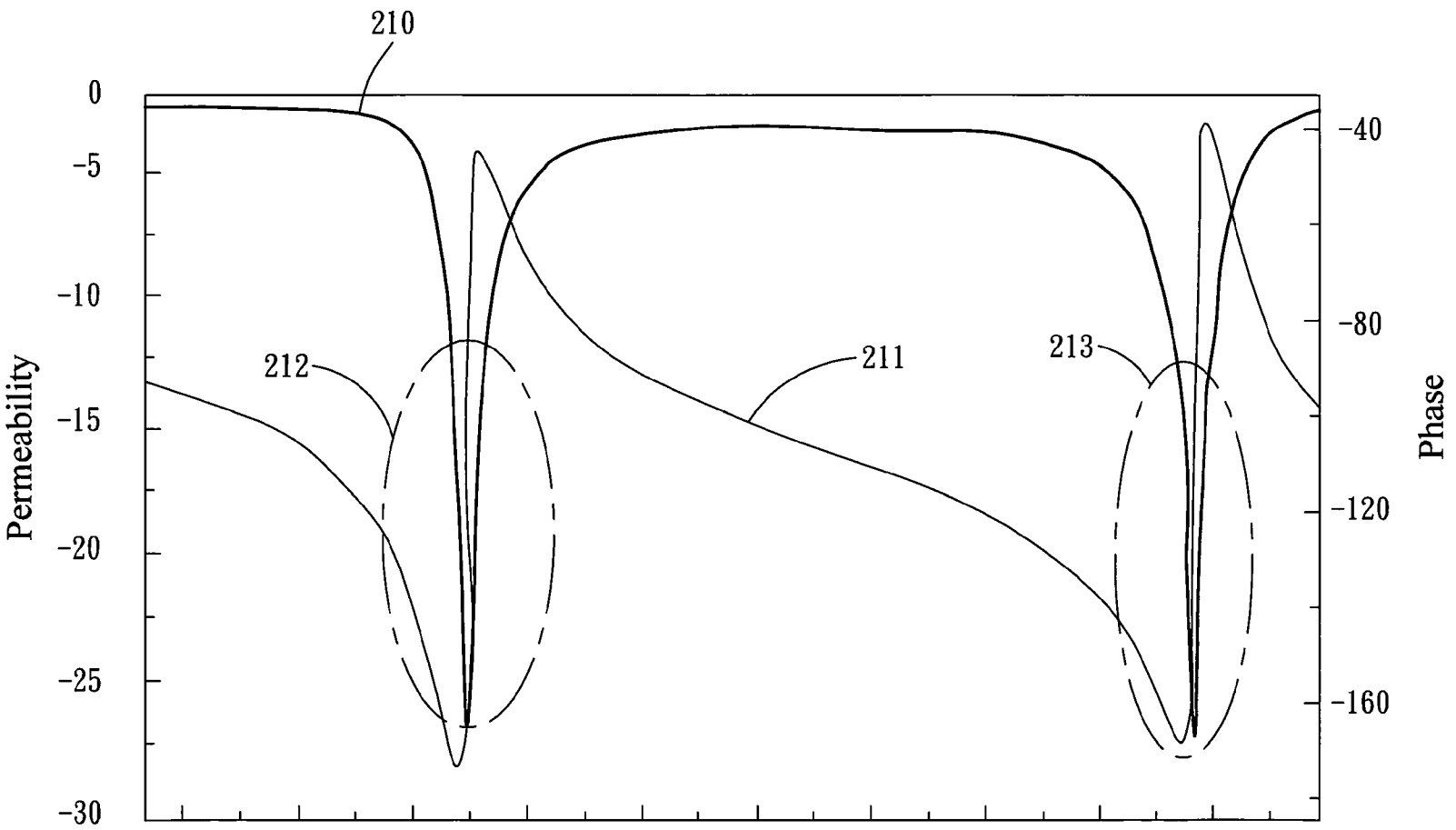
FIG. 3 is a diagram showing the computer-simulated curves of the relationships of the permeability and the frequency of the first crystal cube according to the present invention.
Figure 4:
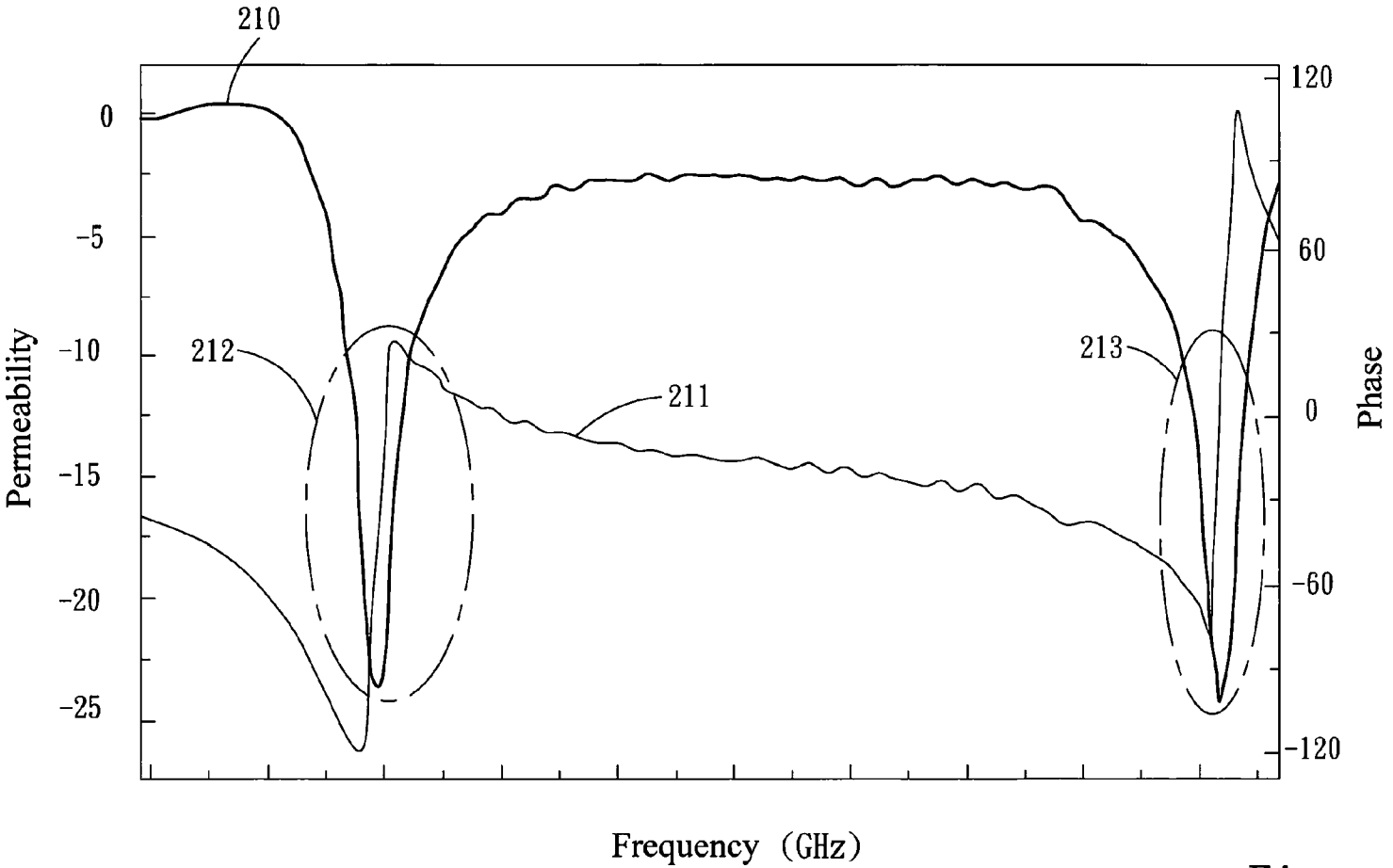
FIG. 4 is a diagram showing the measured curves of the relationships of the permeability and the frequency of the first crystal cube according to the present invention.
Figure 5:
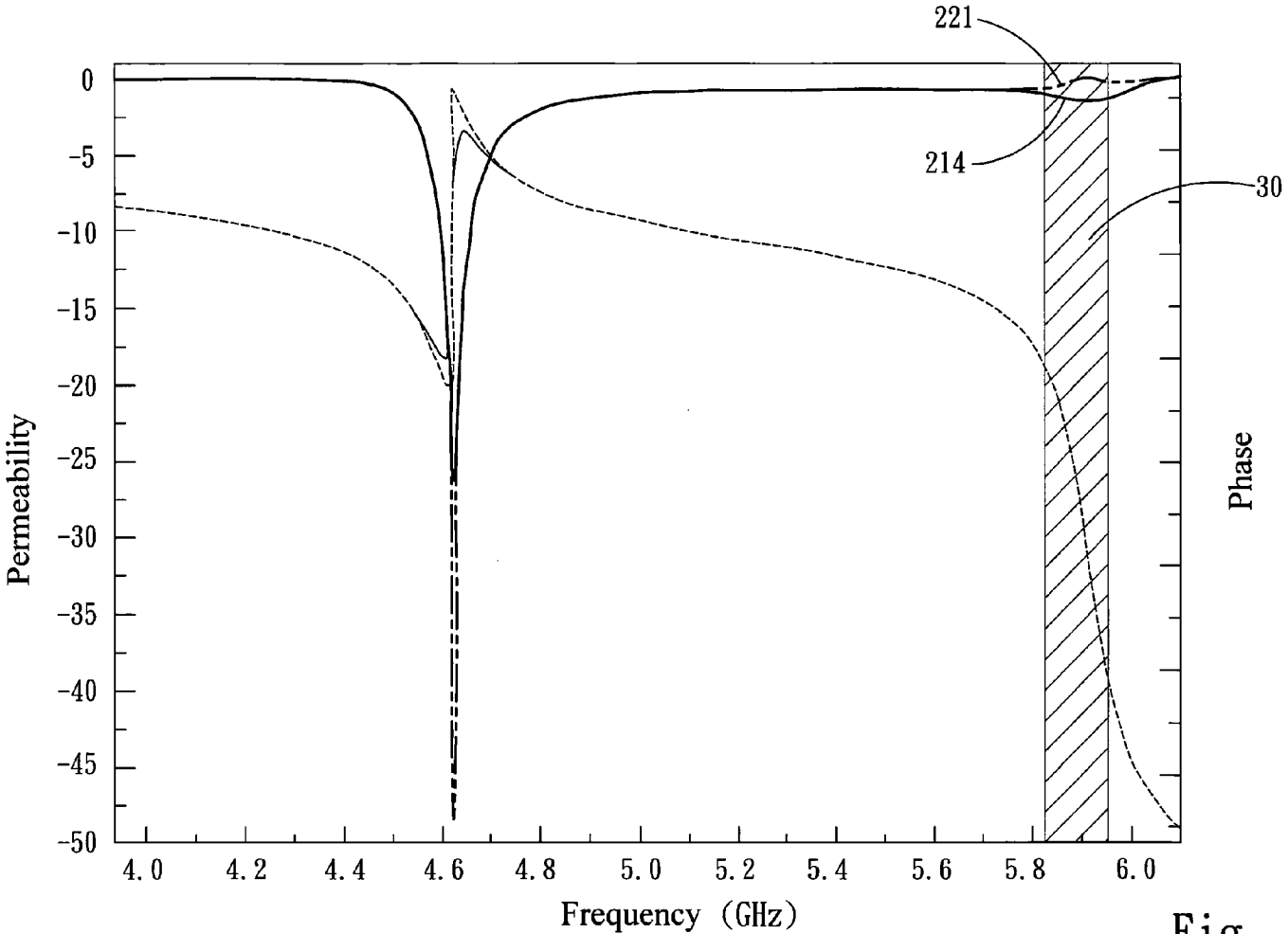
FIG. 5 is a diagram showing the curves of the relationships of the real parts of permeability, frequency and phase according to the present invention.
Figure 6:
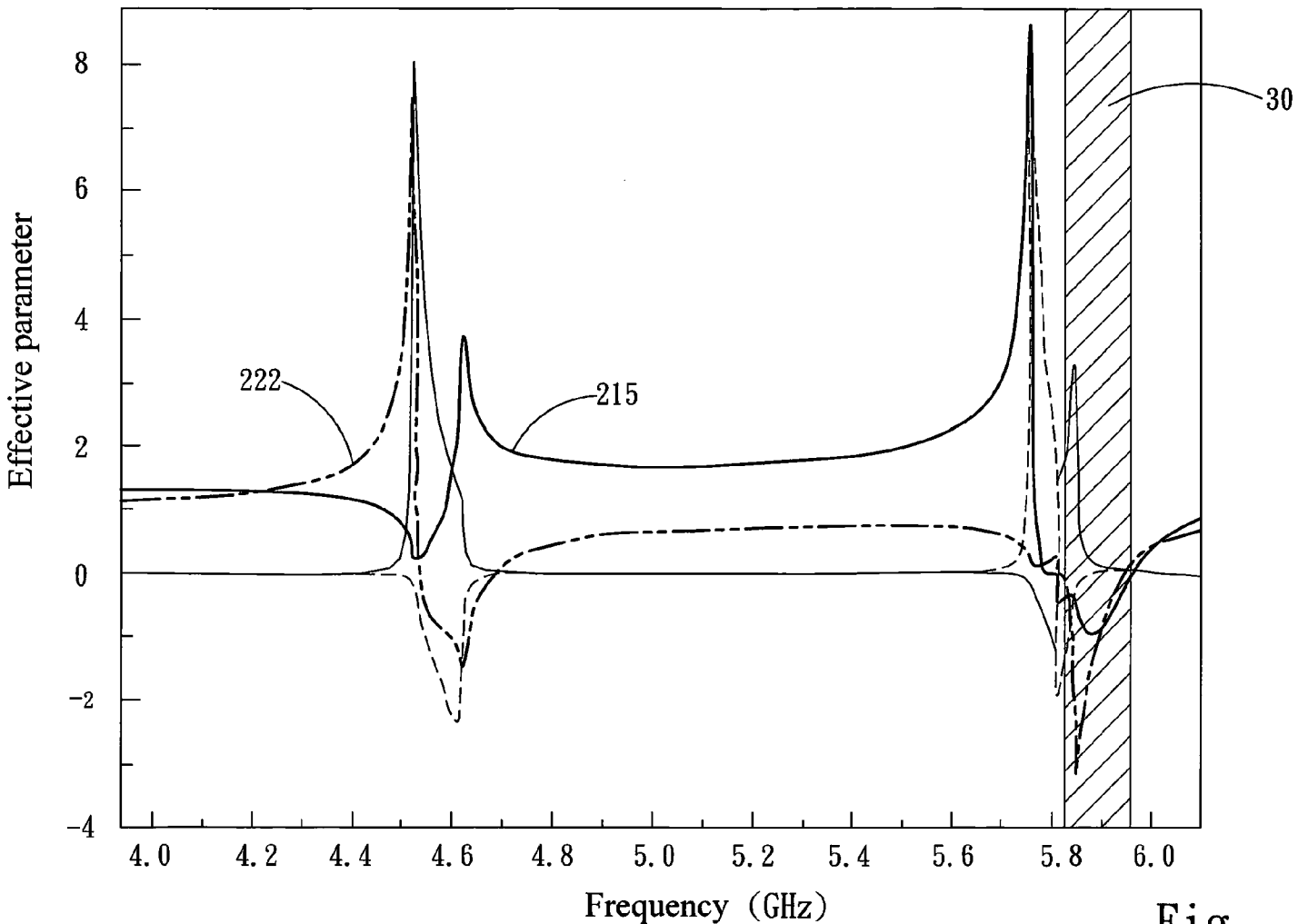
FIG. 6 is a diagram showing a first curve of the relationship of the real parts of the effective parameter and the frequency according to the present invention.
Figure 7:
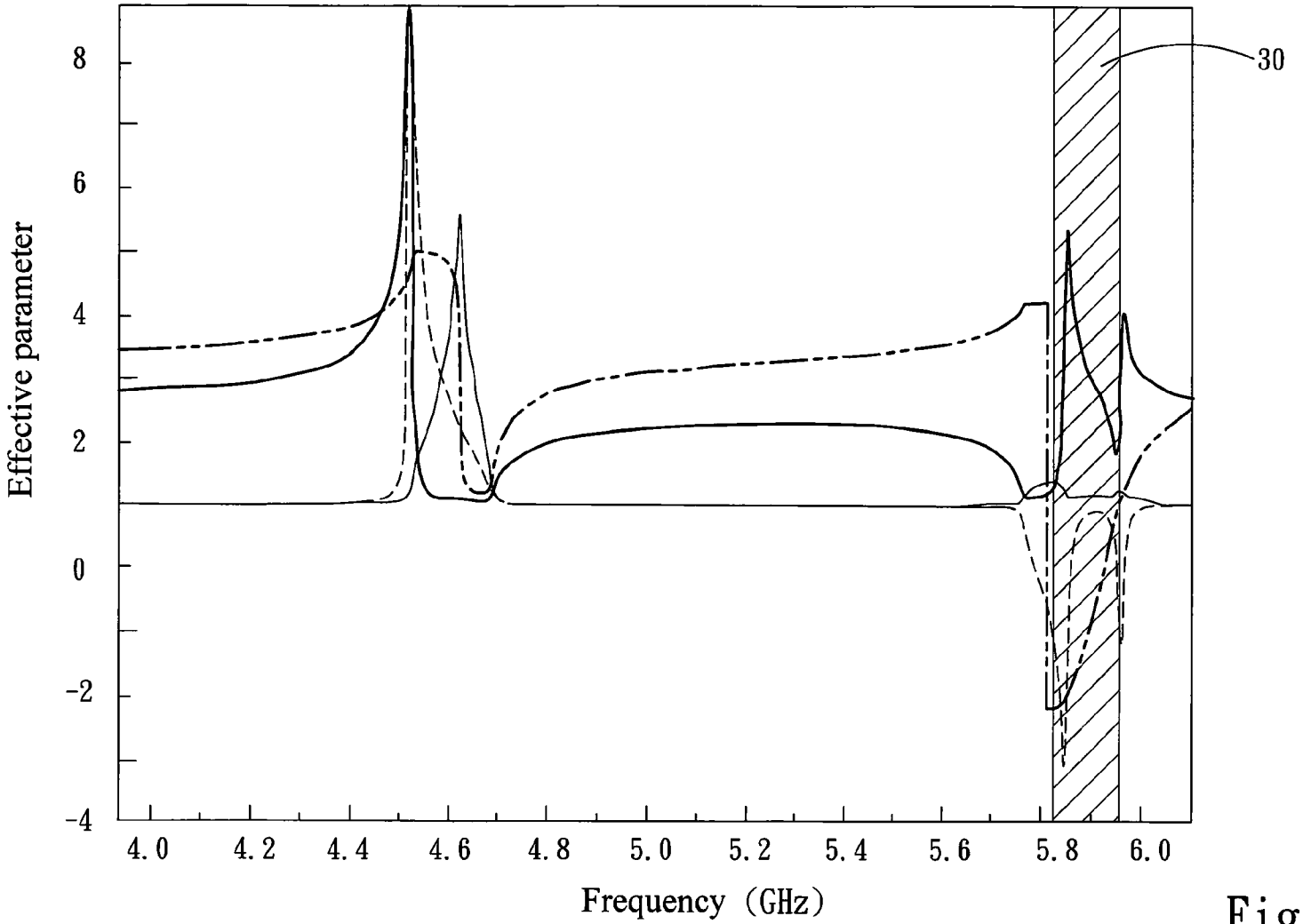
FIG. 7 is a diagram showing a second curve of the relationship of the real parts of the effective parameter and the frequency according to the present invention.
Figure 8:
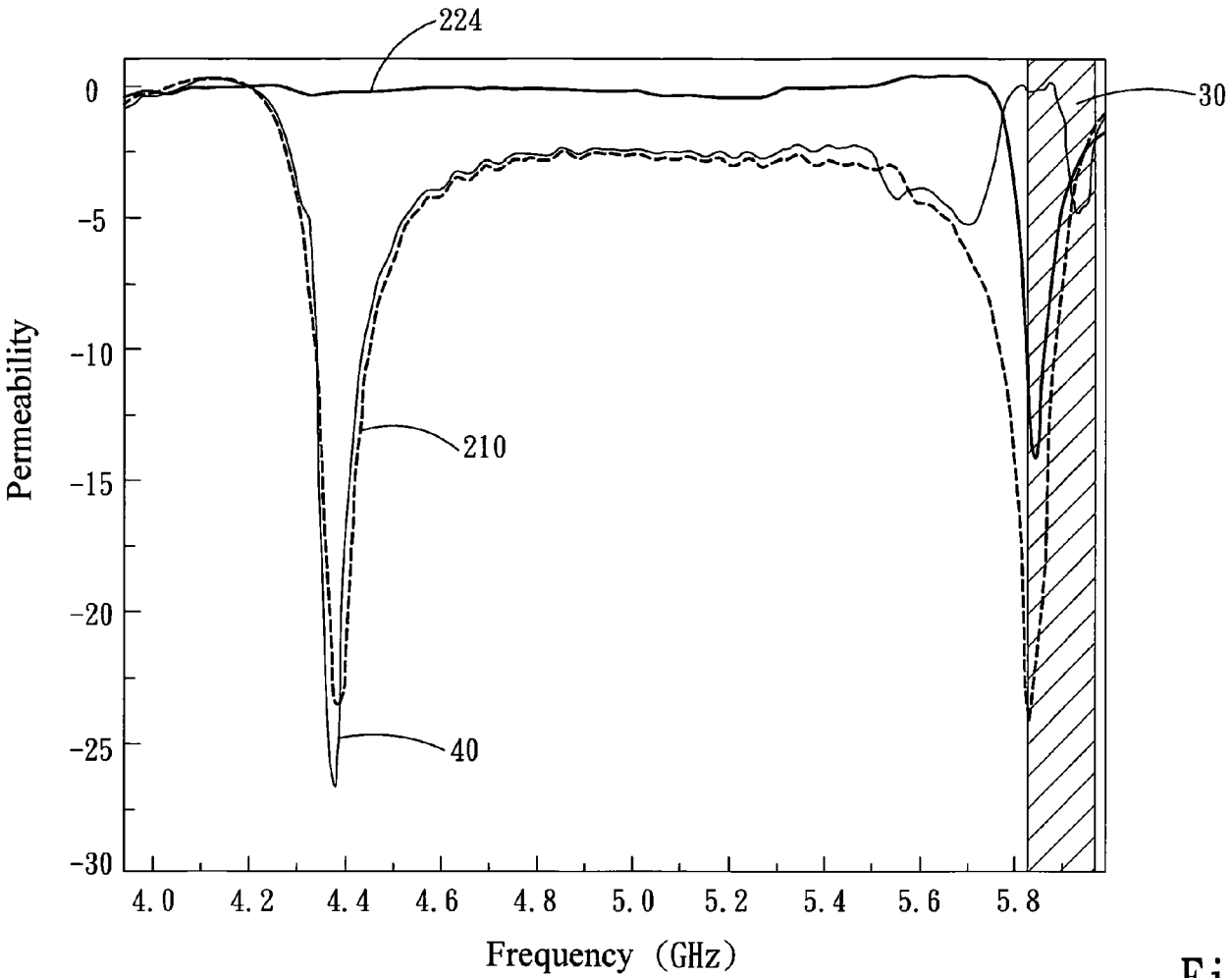
FIG. 8 is a diagram showing curves of the relationships of the permeability and the frequency transmittance according to the present invention.
Figure 9:
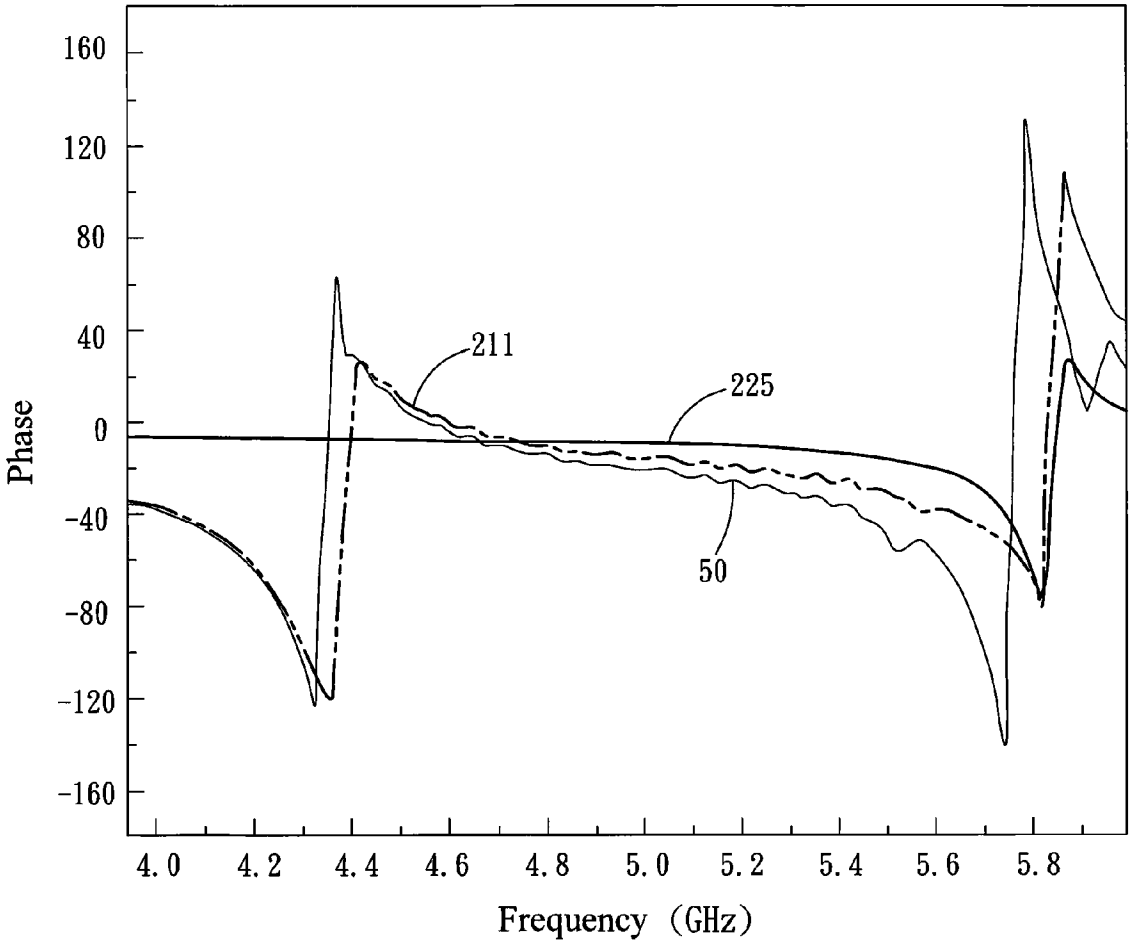
FIG. 9 is a diagram showing curves of the relationships of the permeability and the frequency phase transmission according to the present invention.

Refer to FIGS. 3-9. FIG. 3 is a diagram showing the computer-simulated curves of the relationships of the permeability and the frequency of the first crystal cube according to the present invention; FIG. 4 is a diagram showing the measured curves of the relationships of the permeability and the frequency of the first crystal cube according to the present invention; FIG. 5 is a diagram showing the curves of the relationships of the real parts of permeability, frequency and phase according to the present invention; FIG. 6 is a diagram showing a first curve of the relationship of the real parts of the effective parameter and the frequency according to the present invention; FIG. 7 is a diagram showing a second curve of the relationship of the real parts of the effective parameter and the frequency according to the present invention; FIG. 8 is a diagram showing curves of the relationships of the permeability and the frequency transmittance according to the present invention; and FIG. 9 is a diagram showing curves of the relationships of the permeability and the frequency phase transmission according to the present invention. In FIG. 3, the computer simulates the transmittance curve 210, the phase transmission curve 211, the magnetic response 212 and the electric response 213 of the first crystal cube 21. In FIG. 4, the transmittance curve 210, the phase transmission curve 211, the magnetic response 212 and the electric response 213 of the first crystal cube 21 are all similar to the corresponding curves shown in FIG. 3. In FIG. 3 and FIG. 4, the peaks of the magnetic response 212 and the electric response 213 of the first crystal cube 21 respectively are about 4.51 GHz and 5.78 GHz with a different of only 0.1 GHz.

Refer to FIGS. 5-7 for the measurement results of the performance of the combination of the first crystal cube 21 and the second crystal cube 22, wherein the third spacing 203 therebetween is 7.1 mm. In FIGS. 3-4, the two pointed tips of the transmittance curve 210, i.e. the magnetic response 212 and the electric response 213 of the first crystal cube 21, disappear. In FIG. 5, an action area 30 is formed by a real-part transmittance curve 214 of the first crystal cube 21 and a real-part transmittance curve 221 of the second crystal cube 22. In FIG. 6, an action area 30 is formed by a real-part magnetic response curve 215 of the first crystal cube 21 and a real-part electric curve 222 of the second crystal cube 22. In FIG. 7, an action area 30 has a frequency ranging from 5.8 to 5.95 GHz.

Refer to FIG. 8. Two peaks of a transmittance curve 224 of the second crystal cube 22 respectively are 5.84 GHz and 7.19 GHz (not shown in the drawings). Two peaks of the transmittance curve 210 of the first crystal cube 21 respectively are 4.4 GHz and 5.84 GHz. When the first and second crystal cubes 21 and 22 act simultaneously, a common transmittance curve 40 and the action area 30 appear in FIG. 8. Further, the phase transmission curve 211 of the first crystal cube 21, a phase transmission curve 225 of the second crystal cube 22, and a common phase transmission curve 50 appear in FIG. 9, and a negative refractivity appears in FIG. 9 also. Via adjusting the third spacing 203 to be 7.5 GHz, the common transmittance curve 40 and the common phase transmission curve 50 have a negative refractivity at 5.84 GHz.

In conclusion, the present invention adopts the crystal unit 20 containing the first crystal cube 21 and the second crystal cube 22 both having a permittivity greater than 20 to overcome the conventional problem of high dielectric loss. Thus, the present invention has an advantage of lower dielectric loss. Further, the present invention also features isotropy. Therefore, the present invention has significant industrial utility.

The present invention can easily overcome the conventional problem that the small-volume and low-permittivity elements are hard to assemble, via arranging the first and second crystal cubes 21 and 22, which are made of an identical material, on the substrate 10. Therefore, the present invention can effectively reduce the fabrication cost and has high industrial utility.

What is claimed is:

1. A dielectric resonator for a negative refractivity medium, which is coupled to a plurality of substrates, comprising:

at least one crystal unit, wherein said crystal units are arrayed on said substrate, and wherein on one identical said substrate, each said crystal unit has a first spacing with respect to one adjacent said crystal unit and a second spacing with respect to another adjacent said crystal unit, and said first spacing is vertical to said second spacing;

at least one first crystal cube each arranged inside one said crystal unit; and at least one second crystal cube each arranged inside one said crystal unit, wherein a third spacing exists between said first crystal cube and said second crystal cube, and wherein said first crystal cube and said second crystal cube have a permittivity greater than 20.

2. The dielectric resonator for a negative refractivity medium according to claim 1, wherein said substrates are made of polystyrene.

3. The dielectric resonator for a negative refractivity medium according to claim 1, wherein said crystal unit has a fourth spacing vertical to said substrates and separating said substrates.

4. The dielectric resonator for a negative refractivity medium according to claim 3, wherein said first spacing is defined to be an X axis; said second spacing is defined to be a Y axis; and said fourth spacing is defined to be a Z axis.

5. The dielectric resonator for a negative refractivity medium according to claim 3, wherein said fourth spacing ranges from 20 to 30 mm with 22 mm preferred.

6. The dielectric resonator for a negative refractivity medium according to claim 1, wherein said first spacing ranges from 40 to 50 mm with 47.549 mm preferred.

7. The dielectric resonator for a negative refractivity medium according to claim 1, wherein said second spacing ranges from 20 to 30 mm with 22.149 mm preferred.

8. The dielectric resonator for a negative refractivity medium according to claim 1, wherein said third spacing is parallel to said substrate.

9. The dielectric resonator for a negative refractivity medium according to claim 1, wherein said third spacing ranges from 7 to 8 mm with 7.5 mm preferred.

10. The dielectric resonator for a negative refractivity medium according to claim 1, wherein a volume of said first crystal cube ranges from 7×7×10 to 10×10×10 $mm^3$ with 10×10×10 $mm^3$ preferred.

11. The dielectric resonator for a negative refractivity medium according to claim 1, wherein a volume of said second crystal cube ranges from 2×2×10 to 7×7×10 $mm^3$ with 6.5×6.5×10 $mm^3$ preferred.

12. The dielectric resonator for a negative refractivity medium according to claim 1, wherein said first crystal cube and said second crystal cube are made of a material selected from a group consisting of zirconium dioxide ($ZrO_2$), barium strontium titanate ($(Ba,Sr)TiO_3$), titanium dioxide ($TiO_2$), and lanthanum titanate ($LaTiO_3$).

* * * * *